United States Patent [19]

Sinsko

[11] Patent Number: 4,532,972

[45] Date of Patent: Aug. 6, 1985

[54] PURSE ORGANIZER

[76] Inventor: George V. Sinsko, Rte. 2, Box 158A, Russell Springs, Ky. 42642

[21] Appl. No.: 652,227

[22] Filed: Sep. 20, 1984

[51] Int. Cl.[3] ..... A45C 1/02; A45C 3/06; A45C 13/02; A45C 13/06

[52] U.S. Cl. ..... 150/100; 150/106; 150/120

[58] Field of Search ..... 150/100–102, 150/106, 112, 113, 116, 137, 52 R; 190/102

[56] References Cited

U.S. PATENT DOCUMENTS

| | | | |
|---|---|---|---|
| 1,206,195 | 11/1916 | Beline | 150/106 |
| 1,741,270 | 12/1929 | Altman | 150/106 X |
| 1,766,599 | 6/1930 | Cahill | 150/137 X |
| 2,117,989 | 5/1938 | Ryan | 150/106 |
| 2,183,428 | 12/1939 | McNary | 150/113 X |
| 2,477,388 | 7/1949 | Moore | 150/112 |
| 2,582,447 | 1/1952 | Meyers | 150/113 X |
| 3,085,610 | 4/1963 | Vardan | 150/52 R X |
| 3,220,452 | 11/1965 | Mintzes et al. | 150/137 X |
| 3,326,258 | 6/1967 | Stucker | 150/112 X |
| 3,978,902 | 9/1976 | Adkison | 150/106 |

*Primary Examiner*—William Price
*Assistant Examiner*—Sue A. Weaver
*Attorney, Agent, or Firm*—Normal B. Rainer

[57] ABSTRACT

A device is provided for facilitating the rapid location of items contained within a purse. The device is comprised of a panel of substantially rectangular configuration having a center portion and paired end strips. A number of releasable fasteners adapted to engage said end strips are each provided with a flexible tether line which can be attached to a specific item in the purse. Indicia on the panel correspond to the sought items in the purse. The panel is attached to a sidewall of the purse using rivets which penetrate the center portion of said panel.

4 Claims, 2 Drawing Figures

PURSE ORGANIZER

BACKGROUND OF THE INVENTION

This invention concerns the rapid location of articles contained in a purse, and relates more particularly to a device for rapidly locating articles contained within a purse and removing said articles from the purse.

Numerous aids and systems have been disclosed to facilitate the selective removal of items from crowded carrying bags such as purses, pocketbooks, handbags, and the like. Prior devices have emphasized either the easier visualization of the sought item, or improved storage means to predictably establish the location of the item. Such prior devices have therefore been of limited versatility and relatively complex structure or have required re-design of the purse without providing significant functional effectiveness.

It is accordingly an object of the present invention to provide a device easily adaptable to use with purses of widely varying design to facilitate the rapid location and recovery of articles within the purse.

It is another object of this invention to provide a device as in the foregoing object which functions in a manner independent of the shape or size of the article to be recovered.

It is a further object of the invention to provide a device of the aforesaid nature capable of recovering articles without visual observation and without specially designated storage locations for said articles.

It is a still further object of the present invention to provide a device of the aforesaid nature of simple and durable construction amenable to low-cost manufacture.

These objects and other objects and advantages of the invention will be apparent from the following description.

SUMMARY OF THE INVENTION

The above and other beneficial objects and advantages are accomplished in accordance with the present invention by an improved location device for use in a purse which comprises:

(a) an indicator panel of substantially rectangular configuration having a flat center portion provided with mounting holes and flat vertically disposed coplanar end strips laterally displaced from said center portion as continuous integral extensions thereof, (b) a number of releasable fasteners adapted to engage said end strips, and (c) a flexible tether line attached to each fastener.

In a preferred embodiment of the invention, the releasable fasteners are paper clips fabricated of integral bent wire in a coplanar construction, and are adapted to slideably engage the end strips. The flexible tether lines may be string of multifiber construction or monofilament plastic material such as nylon. The indicator panel may have indicia thereon, and is preferably fabricated from a single piece of flat metal sheet stock.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawings.

DESCRIPTION OF THE PREFERRED EMBODIMENT

Figure 1:
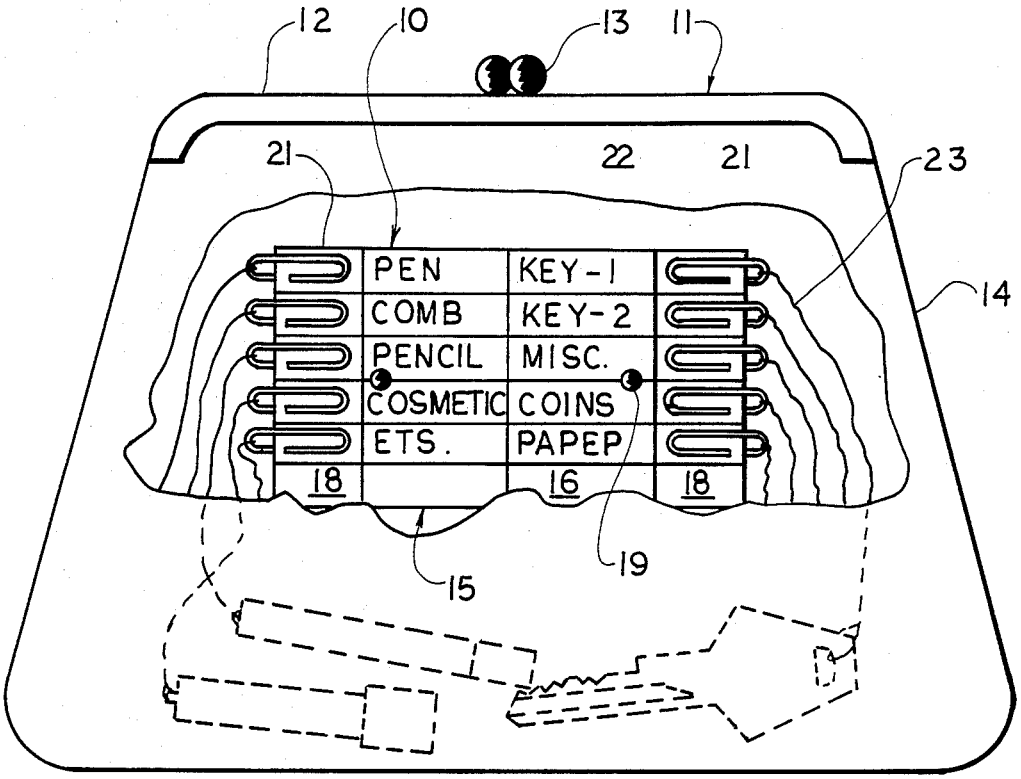
FIG. 1 is a side view of an embodiment of the locator device of this invention shown installed into a purse of conventional design.
Figure 2:
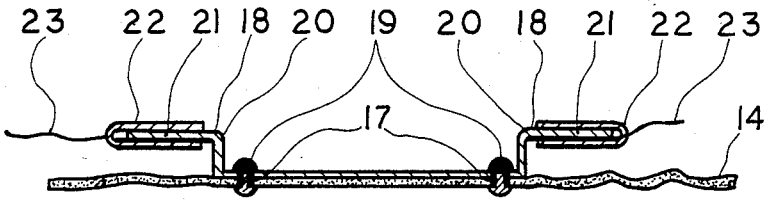
FIG. 2 is a top view of the embodiment of FIG. 1.

Referring to FIGS. 1 and 2, a locator device 10 of the present invention is shown positioned within purse 11. The purse is comprised of pivotably interconnected metal frame members 12, clasp means 13 adapted to controllably interengage the frame members, and pouch compartment 14 pendantly supported by said frame members.

The locator device is comprised of indicator panel 15 having flat center portion 16 provided with mounting holes 17, and flat elongated end strips 18 laterally displaced from center portion 16. Rivets 19, acting through holes 17, join the panel to the sidewall of pouch compartment 14 in a manner causing the long dimensions of the end strips to be vertically oriented.

The illustrated embodiment of panel 15 is fabricated from a single piece of flat sheet metal stock of rectangular configuration. End strips 18 are fashioned by a bending of the sheet metal so as to have two right angle bends 20. Said end strips are in coplanar disposition laterally displaced from center portion 16. In alternative embodiments, panel 15 may be fabricated from plastic by a molding operation.

Printed indicia or provision for entering indicia may be associated with the indicator panel to serve to itemize the contents of the purse. Such itemization may also be achieved through a notch code applied to edge extremities 21 of said end strips.

Paper clips 22 slideably engage end strips 18 from edge extremities 21. One extremity of string 23 is attached to each paper clip. The opposite extremity of each string is attached to the article designated by the indicia upon the panel. In view of the manner of construction and mode of operation of the locator device of this invention, articles contained within a purse or equivalent carrying means can be rapidly retrieved. Because the paper clips are easily disengageable from the panel, the article, with the string and paper clip attached, can be removed from the purse for utilization, and then returned to the purse. The easy removability of the clips also facilitates may untangling of strings which may be required.

The present invention further embraces a purse provided with the locating device. In such combinations, the purse is of a type having two substantially flat sidewall panels adapted to converge in response to the positioning of overhead pivotably interconnected frame members. The locator device is attached to an interior face of one of said sidewalls utilizing rivets which penetrate holes 17.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for rapidly locating articles contained within a purse and removing said articles from the purse comprising:

(a) an indicator panel of substantially rectangular configuration having a flat center portion provided with mounting holes, and flat vertically disposed coplanar end strips laterally displaced from said center portion as continuous integral extensions thereof, (b) a number of releasable fasteners adapted to engage said end strips, and (c) a flexible tether line attached to each fastener.

2. The device of claim 1 wherein said fasteners are paper clips fabricated of wire bent in a coplanar configuration and adapted to slideably engage said end strips.

3. The device of claim 1 wherein said indicator panel is provided with indicia designating sites for engagement of said fasteners.

4. In a purse comprising two elongated rigid frame members pivotably interconnected at their extremities and adapted to meet in planar abutment, and a pouch compartment pendantly supported by said frame members and having two substantially flat sidewalls in facing juxtaposition, the improvement comprising a device of claim 3 attached within said pouch compartment to one of said sidewalls utilizing rivets which penetrate the center portion of said device.

* * * * *